United States Patent [19]

Boutot

[11] Patent Number: 4,568,853

[45] Date of Patent: Feb. 4, 1986

[54] ELECTRON MULTIPLIER STRUCTURE

[75] Inventor: Jean-Pierre Boutot, Paris, France

[73] Assignee: U.S. Philips Corporation, New York, N.Y.

[21] Appl. No.: 755,216

[22] Filed: Jul. 15, 1985

Related U.S. Application Data

[63] Continuation of Ser. No. 680,250, Dec. 11, 1984, abandoned, Continuation of Ser. No. 377,634, May 12, 1982, abandoned.

[30] Foreign Application Priority Data

May 20, 1981 [FR] France ..... 81 10007

[51] Int. Cl.[4] ..... H01J 43/12; H01J 43/18

[52] U.S. Cl. ..... 313/103 CM; 313/105 CM; 313/534

[58] Field of Search ..... 313/103 CM, 105 CM, 313/532, 533, 534, 541, 544

[56] References Cited

U.S. PATENT DOCUMENTS

| | | | |
|---|---|---|---|
| 2,821,637 | 1/1958 | Roberts et al. | 313/105 CM X |
| 3,374,380 | 3/1968 | Goodrich | 313/105 CM X |
| 3,603,828 | 1/1969 | Sheldon | 313/105 CM X |
| 3,854,066 | 12/1974 | Payne | 313/105 CM |
| 4,025,813 | 5/1977 | Eschard et al. | 313/105 CM |

*Primary Examiner*—Palmer C. DeMeo

*Attorney, Agent, or Firm*—Joseph P. Abate

[57] ABSTRACT

An electron multiplier structure comprising an electron multiplier section (11) with one or more microchannel plates and a dynode stage having secondary electron emission. This structure makes it possible to obtain an amplification which is higher than the amplification obtainable with only the electron multiplier section while maintaining the instantaneously obtained characteristics and special resolving power associated therewith.

12 Claims, 4 Drawing Figures

ELECTRON MULTIPLIER STRUCTURE

This is a continuation of application Ser. No. 680,250, filed 12-11-84, now abandoned, which is a continuation of Ser. No. 377,634, filed 5-12-82, now abandoned.

BACKGROUND OF THE INVENTION

The invention relates to an electron multiplier structure comprising at least one microchannel plate having secondary electron emission, which plate comprises an input face and an output face spaced from the input face. The invention also relates to the manufacture of such a structure and to the use thereof in a photo-electric tube.

It is known that the amplification of a microchannel plate with secondary electron emission, hereinafter abbreviated as M.C.P., is restricted by the saturation as a result of the charge of the walls of each channel during the multiplication. The maximum amplification $G_{max}$ corresponds to the maximum charge which is obtained at the output of a channel by multiplication of an electron at the input of said channel. This maximum amplification $G_{max}$ is obtained only when the ratio between the length and the diameter of the channel is sufficiently large. The value of $G_{max}$ inceases with the diameter of the channels (for example, for $d=12.5$ $\mu$m the maximum amplification $G_{max}$ is in the order of magnitude of $10^5$ and for $d=40$ $\mu$m, $G_{max}$ is in the order of magnitude of $10^6$). In picture display devices in which such channel plates are used, the increase of the amplification by increasing the diameter of the channels is at the expense of the spatial resolving power. Moreover, when such amplifications are used, great problems occur which have to be solved. Amplifications of more than $10^4$ can hardly be used in straight channels since with these amplifications the ions formed within the channels form a source of stray phenomena by reaction with the input of the channels, for example, noise pulses, or even in certain cases an uninterrupted noise, generally referred to as "self-generation". When an emissive surface (for example a photocathode) is brought near the input of an M.C.P., the occurrence of these phenomena is considerably stimulated. Therefore the amplification of the tubes of this type (for example picture amplifier tubes) is purposely restricted to comparatively low values ($G \leqq 10^4$). A solution by which one single M.C.P. can operate at high amplifications ($>10^4$) without "breakdown" occurring as a result of ion reaction consists in that the channels are given a curvature. In the case of straight channels it is necessary in practice to obtain high amplifications ($>10^3$) to have the disposal of two or even three microchannel plates which are arranged in cascade and form one or two chevrons. However, this causes some of its characteristics to deteriorate as compared with those of one single M.C.P. operating at its maximum amplification. This relates in particular to the instantaneously obtained characteristics (increase of the pulse response which is associated with the length of the channels), the statistic fluctuation of the amplification, the spatial resolving power (the formation of the electronic avalanche effect between input and output), as well as the noise level which generally increases as a function of the number of microchannel plates whether the system operates or does not operate at its maximum amplification. It is furthermore to be noted that the maximum amplification $G_{max}$ obtained with a multiplier having several M.C.P.'s can hardly be increased by the addition of a further M.C.P. In that case, besides all the above-mentioned characteristics, also the characteristics which relate to a realizable current pulse counting, namely the level N of said signals at the given frequency F or also the frequency F of said signals for a given level N, are found to deteriorate. A disadvantage when one M.C.P. or a combination of M.C.P.'s operates at a high amplification in fact relates to the occurring decrease of the linear amplification dynamic. The average maximum output current $I_{S\,max}$ which can be provided by an M.C.P. during linear operation and the amplification G are as a matter of fact a function of the electric voltage $V_G$ applied between the two sides of the M.C.P. These functions are given by the equations $I_{S\,max}=0.1(V_G/R_G)$ and $G=K\,V_G^{\alpha}$, wherein $R_G$ is the electric resistance between the sides of the M.C.P. and k and $\alpha$ are constants, $\alpha$ being large and for $L/d=40$ is, for example, in the order of magnitude of 10. From this it follows that to each increase by a factor g of the amplification corresponds a reduction by substantially the same factor of the maximum level $I_{E\,max}$ of the current to the input of the M.C.P. which can be amplified during linear operation. With a linear amplification of pulsated signals this results in a decrease of the permissible frequency F for a given level N of the pulses, or conversely a reduction of this permissible level N for a given frequency F. What has been said with reference to the current also applies with reference to the quantity of charge which can be provided by an M.C.P. during linear operation. As a matter of fact it is known that the maximum charge which during linear operation can be provided by a given M.C.P. varies according to $V_G$ and is directly proportional to the multiplication surface used. Hence, the higher the amplification, the lower the pulse charge level which is permissible during linear operation.

SUMMARY OF THE INVENTION

It is the object of the invention to provide an electron multiplier structure which does not show the same disadvantages. For that purpose, the multiplication structure according to the invention is characterized in that a grid-shaped anode and a generally flat dynode are provided mutually parallel and parallel to the output face.

According to the invention the dynode stage at the output can be combined with a prior art multiplier structure only comprising microchannel plates so as to obtain a higher amplification or, in the case of equal amplification, to cause the M.C.P. to operate at lower amplification and to prevent the saturation phenomena inside the microchannel plates and to obtain a better linear operating dynamic, or, in the case of equal amplification, to reduce the number of M.C.P.'s, which has the same results as described above for the linearity. In the latter case the following results occur: As a result of the lower amplification of the M.C.P.'s, one need not have so much fear of the returning ions. Furthermore, the input face of the input stage need not be covered with a diaphragm to screen returning ions, as a result of which, with equal amplification, a simpler construction with improved characteristics, in particular as a result of the smaller number of microchannel plates used, a shorter pulse response, a better canalisation of the electron avalanche effect and hence a better spatial resolving power, a smaller fluctuation in the amplification and a lower noise level can be obtained. Further results relates to the life of the structure, or of the photo-electric tube, in which it is provided. When in fact the structure operates with equal amplification, the actual amplification of the M.C.P.'s proves to be reduced by a factor g equal to that of the dynode stage, as well as the average current provided by the microchannel plates, as a result of which a g times slower decrease of the amplification of said microchannel plates occurs. In the same manner it has been found, when the electron multiplier is accommodated in a photo-electric tube, that the life of the photo-electric layer increases by a factor g. Actually it is known that the decrease in the course of time of the amplification of a multiplier comprising microchannel plates directly depends on the total charge which is provided in the course of time by the microchannel plates and hence depends on the amplification of said stages. It is also known that a photo-electric layer which is provided in the proximity of the input face of a multiplier comprising M.C.P.'s, shows a decrease of its sensitivity in time. This deterioration which is a result of the returning ions from the M.C.P.'s thus also directly depends on the total charge which is provided by the M.C.P.'s, and hence on the amplification of said M.C.P.'s.

A first embodiment is characterized in that the amplifier comprises one microchannel plate which has curved channels. A second embodiment is characterized in that the ratio between the length and the diameter of the channels is larger than 60. A third embodiment is characterized in that the multiplier comprises several microchannel plates forming one or more chevrons. A fourth embodiment is characterized in that the voltages applied to the microchannel plates are such that the microchannel plates operate with maximum amplification and hence operate in the saturation mode. In the case in which the multiplier has one microchannel plate, the electric voltage difference applied across the microchannel plate causes the amplification of a channel to be brought at its maximum value in the order of magnitude of, for example, $10^6$, while the dynode stage causes the total amplification of the multiplier to have a value which may be a few $10^6$ units or a few $10^6$ tens of units.

In case the multiplier has several microchannel plates the electric voltages applied to the various surfaces of the channel plates increase from the input to the output and ensure that, for example, for a combination of three equal microchannel plates the amplifier operates at its maximum amplification in the order of magnitude of, for example, $10^6$. The dynode stage ensures that the total amplification of the multiplier is brought at a value which in this case may be a few $10^6$ units or a few $10^6$ tens of units.

A fifth embodiment is characterized in that the electric voltages applied to the microchannel plates are such that the microchannel plates operate below the maximum amplification and hence do not operate in the saturation mode.

In the case in which the multiplier consists of one single M.C.P., the amplification is reduced by a fraction g with respect to its maximum amplification by the electric voltages applied to the surfaces of the M.C.P. The dynode stage has an amplification, for example, equal to g to reset the total amplification of the multiplier to at least the maximum value of the amplification of one single M.C.P.

In the case in which the multiplier consists of a combination of several microchannel plates which are laid one on top of the other, the amplification is also reduced by a fraction g below its maximum amplification, said amplification reduction being at least compensated for by that of the last dynode stage.

In all these embodiments, in particular when the material of the dynode has a high secondary electron emission coefficient $\delta$, the signal at the dynode is substantially, but for the polarity, equal to that at the anode so that the dynode may be used as an output electrode of the signal. This fact may be used to rather simply make the multiplier sensitive to the determination of the position of the information. As a matter of fact it is necessary for that purpose that the output electrode be subdivided into elements which are electrically insulated from each other. This is difficult to realize with a signal derived from the anode. It would then be necessary to compose the anode from several collectors insulated from each other. Each collector should consist of a grid or a fabric of wires which must be very transparent. Such a structure, as far as the anode is concerned, is not easy to obtain particularly not if two-dimensional information is desired about the position (for example, a mosaic structure). A sixth embodiment which can more easily be realized is characterized in that the dynode consists of several elements insulated electrically from each other.

According to a further embodiment the anode is formed by a grid formed integrally. The position information is obtained by means of the signal received at the dynode elements, while the signal received at the anode may serve, for example, as a time reference signal (for synchronization) or as an amplitude reference signal (for level selection). According to another embodiment the anode is formed by a grid of parallel wires insulated from each other. This makes it possible to form, with the elements of the dynode, a matrix device for reading out two-dimensional position information according to the generally known principles.

According to further embodiments of the invention the emitter material of the dynode consists either of a metallic alloy oxidized at the surface, for example, CuBeO, AgMgO and AlMgO or of a layer of a material having secondary electron emission provided on a substrate in which, if desired, an oxidized or non-oxidized intermediate layer is provided between the layer and the substrate. The material having secondary electron emission is, for example, MgO, CsI or $Na_3AlF_6$, or is an alkali-antimonide, for example, SbCs, SbkCs, SbRCs or SbNaKCs. For this latter group of materials a method of manufacturing electron multiplying structures which previously are provided in an evacuated envelope of a photo-electric tube, is characterized in that the method comprises the steps of depositing antimony on a dyonde substrate of grains of antimony which are uniformly spread on the anode, the evaporation of antimony taking place by the passage of an electric current through the anode and the evaporation of one or more alkali metals from sources which are provided permanently in the tube or are provided in a space which, prior to sealing, communicates with the tube via an exhaust tube.

Still another embodiment is characterized in that the material having secondary electron emission is a semiconductor material which is provided in a state of negative electron affinity, for example, GaP (Cs—O), GaAs (Cs—O) or Si (Cs—O). The fact that the dynode, as well as the anode, is flat, this in contrast with the dynode in a usual photomultiplier, makes it possible to use a high electric voltage which, for example, is more than 1 kV, between the last microchannel plate and the dynode, without having to fear for cold electron emission. As a result of this a monocrystalline form is chosen for the material having negative electron affinity. This material, taking into account the applied electric voltage, is used with a high emissive power which may be higher than 50. For the use of such materials a method of manufacturing an electron multiplier structure which is previously provided in the envelope of a photo-electric tube is characterized in that the thermal cleaning treatment of the semiconductor material takes place prior to vapour-depositing caesium by means of radiation originating from a source of radiation present outside the envelope.

BRIEF DESCRIPTION OF THE DRAWINGS

The invention will now be described in greater detail, by way of example, with reference to a few embodiments and the accompanying drawing, in which.

DESCRIPTION OF THE PREFERRED EMBODIMENTS

Figure 1:
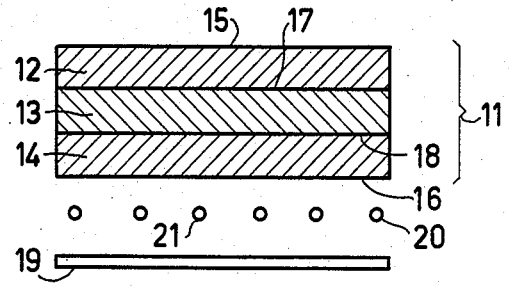
FIG. 1 is a sectional view of the electron multiplier structure in its most general form.

FIG. 1 shows an electron multiplier structure which consists of a stack 11 of microchannel plates 12, 13 and 14. The input and output faces of the stack 11 are referenced 15 and 16, respectively, and the faces which are common for the channel plates in the stack are referenced 17 and 18, respectively. The electric voltages which are applied to the faces of the channel plates increase from face 15 to face 16. The electrons to be multiplied are presented to the face 15. A second multiplier stage succeeds the stack 11. It consists of the dynode 19 and the anode 20 which are both flat and parallel to the face 16 of the channel plate. The anode 20 is a grid in the form of a fabric of parallel wires 21 (perpendicularly to the plane of the Figure) or in the form of a grid of wires. The electric voltage of this anode 20 is positive with respect to that of the face 16 of the last channel plate 14, while the voltage of the dynode 19 is between that of the face 16 and that of the anode 20. As a result of this the anode 20 proves to be transparent to the electrons emitted by the channel plate 14. The electrons which impinge on the dynode 19 are multiplied there, the released secondary electrons being collected by the anode 20.

The various embodiments and modified embodiments thereof differ from each other with respect to the electric voltages of the channel plates and the dynode and consequently also the operating mode.

Figure 2:
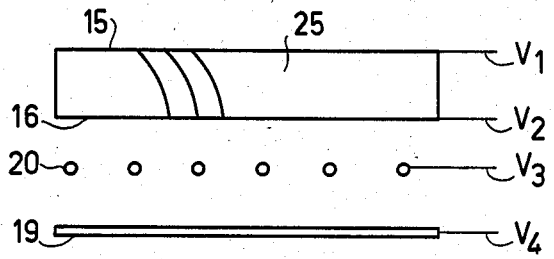
FIG. 2 is a sectional view of an electron multiplier structure according to a first and a second embodiment of the invention.

A first embodiment is shown in FIG. 2. The multiplier only comprises one microchannel plate 25. The channel 25 has curved channels to be able to operate at maximum amplification without this leading to a rapid deterioration, as a result of returning ions, of the quality of the photocathode of the photoelectric tube in which the structure can be provided. The length and the diameter of said channels is, for example, $l=3.2$ mm and $d=40$ μm. The electric voltages which are applied to the faces 15, 16 of the channel plate 25 are $V1=0$ volt and $V2=1500$ volts, respectively. The amplification of the channel plate 25 then lies in the order of magnitude of $10^6$. The electric voltages on which the anode 20 and the dynode 19 have been brought are $V3=2100$ volts and $V4=1800$ volts, respectively. At these voltages the multiplier structure has a total amplification of a few $10^6$ to $10^7$ units. The emissive material of the dynode 19 is, for example, a metal oxide, for example, BeO or MgO.

In this first embodiment the electric voltages are such that the multiplier having the microchannel plate 25 operates at its maximum amplification, which for the channel plate 25 corresponds to the channel saturation mode for an electron at the input of a channel of the channel plate 25.

A second embodiment will also be described in detail with reference to FIG. 2. This embodiment differs from the first embodiment in that the electric voltages which are applied to the faces 15 and 16 of the channel plate 25 are such that the multiplier does not operate at its maximum amplification which corresponds to the channel saturation mode for an electron present at the input. As a result of this the multiplier having the channel plate 25 has a given increased linear amplification range for the average electric current or charge at the input of the multiplier. The electric voltages of the channel plate 25 are fixed at such a value that the amplification of the multiplier is reduced by a factor g with respect to its maximum, corresponding to the operation in the channel saturation mode. The maximum of the signal which can be amplified linearly is increased by the same factor g. The decrease of the amplification of the multiplier having the channel plate 25 is compensated for at least by the amplification factor of the dynode stage. The voltages applied to the faces 15 and 16 of the channel plate are, for example, $V1=0$ volt and $V2=1200$ volts, respectively. With these values the amplification of the channel plate 25 is in the order of magnitude of $10^5$, which is a factor 10 lower than that according to FIG. 2. This amplification reduction is at least compensated for by that of the dynode stage, when the anode 20 and the dynode 19 are brought at a voltage of $V3=1800$ volts and $V4=1500$ volts, respectively. The maximum signal of the average current at the input of the structure which can be amplified linearly lies in the order of magnitude of $10^{-12}$ A/cm$^{-2}$ when, for example, the average maximum output current which can be provided by an M.C.P. during linear operation is $10^{-7}$ A/cm$^{-2}$.

Figure 3:
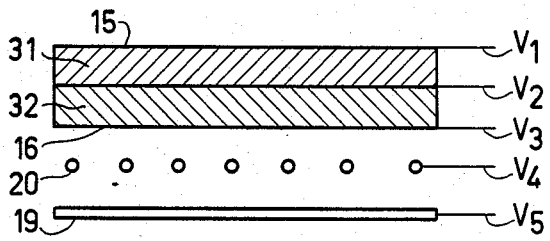
FIG. 3 is a sectional view of an electron multiplier structure according to a third and a fourth embodiment of the invention.

A third embodiment is shown in FIG. 3. The multiplier comprises two channel plates 31 and 32 having straight channels, the channels of one channel plate being inclined with respect to those of the other channel plates in such manner that the channel plates 31 and 32 form a chevron. The length l and the diameter d of the channels of the plates 31 and 32 are, for example, $l=0.5$ mm and $d=12.5$ μm. In this embodiment the applied electric voltages are such that the multiplier operates at its maximum amplification, which for the channel plates 31, 32 corresponds to the channel saturation mode for an electron at the input of a channel. The voltages applied to the faces 15, 17 and 16 of the channel plates 31 and 32 are, for example, $V1=0$ volt, $V2=900$ volts and $V3=1800$ volts, respectively. At these voltages the amplification of the channel plates 31, 32 is in the order of magnitude of $10^5$. At this high amplification the chevron prevents too large numbers of ions from returning. The voltages applied to the anode 20 and the dynode 19 are V4=2400 volts and V5=2100 volts, respectively. The amplification of the dynode stage then is from a few units to 10. Herewith a total amplification of a few $10^5$ to $10^6$ units is ultimately obtained for the whole multiplier structure.

A fourth embodiment will also be described with reference to FIG. 3. This embodiment differs from the third embodiment in that the electric voltages applied to the faces 15, 17 and 16 are such that the channel plates 31, 32 do not operate at maximum amplification. The voltages applied to the faces 15, 17 and 16 are, for example, V1=0 volt, V2=700 volts and V3=1400 volts, respectively, while the voltages applied to the anode 20 and the dynode 19 are V4=2000 volts and V5=1700 volts, respectively. The channel plates 31, 32 operate at an amplification which is lower than the maximum amplification by a factor g, at the given voltages in the order of magnitude of 10. On the other hand the dynode stage at least compensates for the amplification reduction of the channel plates. The maximum of the signal of the average current which can be amplified at the input of the structure lies in the order of magnitude of $10^{-11}$ $A/cm^{-2}$ when, for example, the average maximum output current which can be provided during linear operation by the output channel plate 32 is $10^{-7}$ $A/cm^{-2}$.

In all the above-described embodiments the characteristics of the structure apart from the ultimate amplification, depend substantially on the multiplier part consisting of microchannel plates. This also applies to the linear amplification range in which it deals with the maximum level of electric direct current signals to be amplified linearly, or, during pulse operation, with the maximum level N of the current or the charge of said pulses at a given frequency f which can be amplified linearly, or with the maximum frequency f for a given level N of the pulses. Also fixed by the channel plates are the instantaneously obtained characteristics (increase of the pulse response), the statistic fluctuation in the amplification, the spatial resolving power (the formation of the electron avalanche effect between input and output) and the signal-to-noise ratio, all characteristics of the structure being an accurate function of the number of channel plates of the multiplier and of the geometric dimensions of the channels. When a supplementary amplification is available as a result of the dynode stage, a less large number of channel plates or an equal number of channel plates at lower amplification may be used for an equal total amplification, as a result of which the above-mentioned characteristics can be improved or the said characteristics can remain the same for an increased total amplification in which the same number of channel plates is used.

Figure 4:
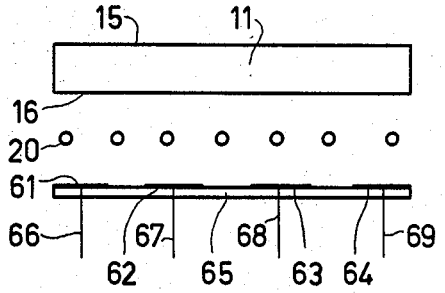
FIG. 4 shows a fifth embodiment of an electron multiplier structure having a subdivided dynode.

A fifth embodiment according to which the multiplier is made sensitive to the determination of the position of the presented information will be explained with reference to FIG. 4. In this Figure, the same components are referred to by the same reference numerals as in FIG. 2. In order to make the multiplier sensitive to the determination of the position, the dynode is constructed as a mosaic of independent elements. The dynode comprises the elements 61, 62, 63, 64 having a high coefficient of secondary emission δ, which extend at right angles to the plane of the drawing. The elements 61 to 64 are provided on an insulating substrate 65. The elements 61 to 64 are brought at an electric voltage which is between that of the plane 16 of the channel plate 11 and that of the anode 20. The voltages are presented via conductors 66, 67, 68 and 69, respectively, which also make it possible to derive the signal via a capacitive connection. A supply with the dynodes at earth potential can be endeavoured and in that case an output via a capacitive connection is not necessary. During providing the multiplication structure in a photo-electric tube, said subdivided dynode in particular is manufactured by deposition on an insulating substrate which consists of a part of the envelope of the tube, said part comprising conductors, for example, 66 to 69, for deriving the signal outside the tube.

According to the invention the dynode can be manufactured from various materials. The dynode may be constructed to be solid and, for an amplifier in a sealed tube, may consist of an alloy, for example, Cu—BeO, Ag—MgO, Al—MgO oxidized at the surface, the emissive capacity of said metal oxide being increased by adsorption at the surface of an alkali element, for example Cs. The dynode can also be obtained by deposition on a substrate of a material having a high secondary emission coefficient, for example, MgO, CsI, $Na_3AlF_6$, or in the case of a sealed tube, alkali-antimonides, for example SbCs, SbK Cs . . . . When said antimonides are used according to the invention a method is used of forming said dynodes "at the area" within the photoelectric tube, said dynodes after their formation being no longer exposed to air. The antimony layer necessary for the formation of said dynodes is obtained by evaporating antimony. Starting material are grains of said metal which are previously spread uniformly on one or several wires of the anode (as 21 in FIG. 1). Evaporation takes place by passing an electric current through the wires which is supplied by an external current source. The other steps to form said dynodes are known steps, namely the evaporation of one or more alkali metals from sources which are permanently provided in the tube or are provided in a space which prior to sealing communicates with the tube via the exhaust tube. Still for the case in which the multiplication structure is provided in a sealed tube, the dynode may also be formed from semiconductor material having a negative electron affinity, for example, GaP (Cs—O), GaAs (Cs—O), Si (Cs—O) . . . . As a result of the flatness of the dynode and the anode and their parallelism to each other and with respect to the output face of the last channel plate, high voltages can be applied between the various electrodes, in particular between the output face and the dynode. This latter voltage may be in the order of magnitude of, for example, 1 kV or several kV, without having to fear for cold electron emission from the output face of the channel plates. The selected semiconductor material is preferably monocrystalline, which, taking into account the high applied electric voltage, yields a high emissive power in the order of magnitude of, for example, 50. This dynode is preferably provided at one end of the tube. The thermal cleaning of the semiconductor material which has to be carried out prior to vapour-depositing caesium thereon, takes place according to the invention by means of radiation which originates from a radiation source outside the envelope.

What is claimed is:

1. An electron multiplier structure which comprises:

a microchannel plate having secondary electron emission during normal operation of the structure, the plate including an input face and an output face spaced from the input face, characterized in that the structure further comprises a grid-shaped anode and a generally flat dynode, the dynode including an electron emissive material, and that the anode and the dynode are mutually parallel and are parallel to the output face, the anode being disposed and spaced between the output face and the dynode.

2. An electron multiplier structure as claimed in claim 1, characterized in that the microchannel plate has a plurality of curved channels.

3. An electron multiplier structure as claimed in claim 2, characterized in that each channel has a length/diameter ratio which is greater than 60.

4. An electron multiplier structure as claimed in claim 1, characterized in that the dynode includes a substrate and a plurality of electron emissive elements provided on the substrate, the elements being insulated electrically from each other.

5. An electron multiplier structure as claimed in claim 1, characterized in that the anode includes a grid of mutually parallel wires insulated from each other.

6. An electron multiplier structure as claimed in claim 1, characterized in that the input face is at a first voltage and the output face is at a second voltage, the first and second voltages being such that the microchannel plate operates at a maximum amplification.

7. An electron multiplier structure as claimed in claim 1, characterized in that the input face is at a first voltage and the output face is at a second voltage, the first and second voltages being such that the microchannel plate operates at less than a maximum amplification.

8. An electron multiplier structure as claimed in claim 1, characterized in that the dynode consists essentially of a surface-oxidized metallic alloy selected from the group consisting of CuBeO, AgMgO and AlMgO.

9. An electron multiplier structure as claimed in claim 4, characterized in that the electron emissive elements consist essentially of a material selected from the group consisting of MgO, CsI and $Na_3AlF_6$.

10. An electron multiplier structure as claimed in claim 4, characterized in that the electron emissive elements consists essentially of an alkali-antimonide material selected from the group consisting of SbCs, SbKCs, SbRbCs and SbNaKCs.

11. An electron multiplier structure which comprises:

a plurality of microchannel plates each having secondary electron emission during normal operation of the structure, the plates being arranged in a stack, the stack including an input face and an output face spaced from the input face, characterized in that the structure further comprises a grid-shaped anode and a generally flat dynode, the dynode including an electron emissive material, and that the anode and the dynode are mutually parallel and are parallel to the output face, the anode being disposed and spaced between the output face and the dynode.

12. An electron multiplier structure as claimed in claim 11, characterized in that each plate has channels arranged such that the channels of adjacent plates form chevrons.

* * * * *